US006478074B1

(12) United States Patent
Basler et al.

(10) Patent No.: US 6,478,074 B1
(45) Date of Patent: Nov. 12, 2002

(54) METHOD FOR THE PRODUCTION OF A STEEL CAMSHAFT AND CAMSHAFT PRODUCED ACCORDING TO SAID METHOD

(75) Inventors: Martin Basler, Gaildorf (DE); Ulrich Engelhart, Fellbach (DE); Peter Grahle, Gerlingen (DE); Volker Korte, Bissingen (DE); Jürgen Schmid, Gaildorf-Münster (DE); Matthias Vogelsang, Stuttgart (DE); Jens Wiesenmüller, Lienen (DE)

(73) Assignee: MAHLE Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 09/744,007

(22) PCT Filed: Jul. 21, 1999

(86) PCT No.: PCT/DE99/02244

§ 371 (c)(1),
(2), (4) Date: Mar. 16, 2001

(87) PCT Pub. No.: WO00/06320

PCT Pub. Date: Feb. 10, 2000

(30) Foreign Application Priority Data

Jul. 25, 1998 (DE) ..... 198 33 594

(51) Int. Cl.[7] ..... B22C 9/02; B22C 9/22; B22C 7/02; B22D 27/09

(52) U.S. Cl. ..... 164/34; 164/364; 164/246; 164/135; 164/120; 164/244

(58) Field of Search ..... 164/34, 363, 235, 164/246, 35, 135

(56) References Cited

U.S. PATENT DOCUMENTS

| | | | | |
|---|---|---|---|---|
| 4,434,006 A | | 2/1984 | Kato et al. | |
| 4,673,023 A | * | 6/1987 | Winston | 164/246 |
| 5,013,611 A | | 5/1991 | Suzuki et al. | |
| 5,503,797 A | * | 4/1996 | Zoch et al. | 420/38 |
| 5,560,420 A | * | 10/1996 | Hansen et al. | 164/114 |

FOREIGN PATENT DOCUMENTS

| | | | |
|---|---|---|---|
| DE | 2 041 777 | | 2/1972 |
| DE | 24 24 590 | | 12/1975 |
| DE | 120 104 | | 6/1976 |
| DE | 34 16 132 | | 11/1985 |
| DE | 36 13 191 | | 10/1986 |
| DE | 35 32 196 | | 7/1987 |
| DE | 38 15 844 | | 11/1988 |
| DE | 41 00 779 | | 10/1992 |
| DE | 44 25 517 | | 1/1995 |
| DE | 44 11 795 | | 12/1995 |
| DE | 44 31 713 | | 3/1996 |
| JP | 61 115 660 | | 6/1986 |
| JP | 361115660 A | * | 6/1986 |
| JP | 62 296 935 | | 12/1987 |
| JP | 362296935 A | * | 12/1987 |
| JP | 02 102 302 | | 10/1988 |
| JP | 63 264248 | | 11/1988 |
| JP | 363264248 A | * | 11/1988 |
| JP | 01 062444 | | 3/1989 |

(List continued on next page.)

OTHER PUBLICATIONS

Metals Handbook, Davis, ASM International, Desk Edition, Second Edition, p. 348, 351.*

*Primary Examiner*—M. Alexandra Elve
*Assistant Examiner*—Kevin McHenry

(57) ABSTRACT

The invention relates to a camshaft made of cast steel having an inner cavity with a cylindrical inner shape, especially a profiled cylindrical inner shape produced rationally according to a lost-foam casting method known per se. A steel camshaft thus produced exhibits a long service life and can withstand extremely high hertzian surface pressures on its bearing surfaces without any damages.

8 Claims, 1 Drawing Sheet

FOREIGN PATENT DOCUMENTS

| | | | |
|---|---|---|---|
| JP | 401062444 A | * | 3/1989 |
| JP | 01 238765 | | 9/1989 |
| JP | 401238765 A | * | 9/1989 |
| JP | 402084228 A | * | 3/1990 |
| JP | 02 137641 | | 5/1990 |
| JP | 402137641 A | * | 5/1990 |
| JP | 402175045 A | * | 7/1990 |
| JP | 04 167946 | | 6/1992 |
| JP | 404167946 A | * | 6/1992 |
| JP | 07 001076 | | 1/1995 |
| JP | 07 011377 | | 1/1995 |
| JP | 410298710 A | * | 11/1998 |

* cited by examiner

METHOD FOR THE PRODUCTION OF A STEEL CAMSHAFT AND CAMSHAFT PRODUCED ACCORDING TO SAID METHOD

CROSS REFERENCE TO RELATED APPLICATIONS

Applicants claim priority under 35 U.S.C. §119 of German Application No. 198 33 594.6 filed Jul. 25, 1998. Applicants also claim priority under 35 U.S.C. §120 of PCT/DE99/02244 filed Jul. 21, 1999. The international application under PCT article 21(2) was not published in English.

BACKGROUND OF THE INVENTION

1. Field of the Invention

The invention relates to a procedure for manufacturing a one-piece, profiled, hollow steel camshaft. Profiled denotes that the camshaft is tubular, with a profiled inner jacket surface, which in some extent matches the contours of the cams and bearing areas on the camshaft.

2. The Prior Art

Steel camshafts are known from JP 02 102 302 A, JP 41 67 946 A, JP 12 38 765 A, JP 63 264 248 A for example.

Generic camshafts are suitable and intended for valve trains of internal combustion engines, in which the valves are actuated in particular through roller contact with the camshaft. In these cases, camshafts are required that can withstand Hertzian surface pressures of up to 2,500 MPa during the entire engine service life without any damage to its bearing surfaces. The advantages to the hollow camshaft design include cutting down on weight and being able to lubricate through the camshaft.

Known from JP 61 115 660 A, JP 41 67 946A, JP63 264 248A and JP 62 296 935 A is to manufacture camshafts out of cast iron in a lost-foam casting procedure.

SUMMARY OF THE INVENTION

The object of the invention is to be able to manufacture a generic camshaft out of a high strength material as rationally as possible.

The casting models are designed according to the principle of the lost-foam casting system. This means that the camshaft is generated and used as a lost mold, e.g., consisting of a polymer blank, with a slight outside addition of material for final processing. This blank dissolves when the cast steel is filled in, and is placed in a sand mold, wherein the hollow interior cavity is also filled completely with sand.

The polymer used has a special chemical composition, which prevents the harmful carbonization processes from taking place while pouring in the liquid steel. This satisfies the high geometric requirements placed on the casting mold during the implementation of the instruction according to the invention.

To prevent casting defects and for economic considerations, a special feed system is used according to the invention, making it possible to simultaneously cast numerous camshafts, e.g., more than 50. The plug-in system is used to ensure the stability of a so-called nest of molds comprised of more than 50 camshaft blanks with feed system. Adhesives need not be used here, which reflects favorably on casting quality.

BRIEF DESCRIPTION OF THE DRAWING

The drawing shows an embodiment for the procedure according to the invention.

In this diagrammatic representation, the sole FIGURE shows.

DETAILED DESCRIPTION OF THE PREFERRED EMBODIMENTS

Figure 1:
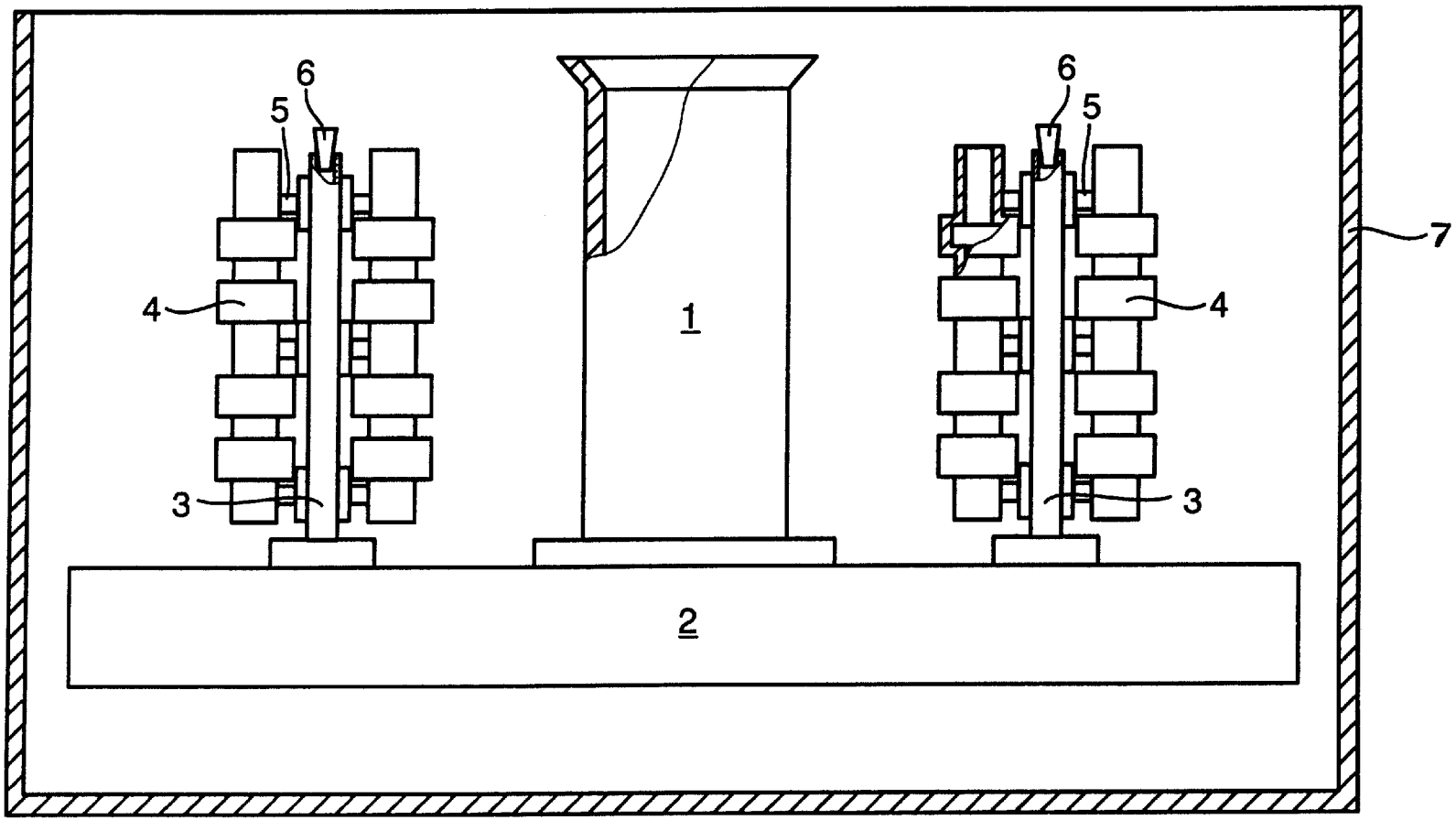
FIG. 1 a sand mold box without sand, with a casting mold arrangement consisting of numerous individual, interconnected casting molds.

The depicted casting mold arrangement consists of a central, vertically aligned fill channel 1 for casting material to be filled into the arrangement, whose lower end is linked via horizontally and radially branching connecting channels 2 with casting channels 3 for the meltable camshaft models 4. All above parts consist of a material that melts under the casting material, e.g., a polymer known for the lost-foam casting procedure. However, it may make sense to make the fill channel 1 out of a non-melting material.

The camshaft casting models 4 are arranged axially parallel to the respective casting channel 3 around which they are distributed, and linked with the latter over its height by several notched connections 5.

The individual casting channels 3, which can be numerous, are sealed at their top ends with a ceramic plug 6 as the throttle valve.

The parts 1, 2, 3, 4, and if necessary 5, of the casting arrangement that melt during the casting procedure are coated on their surfaces with a dimensionally stabilizing coating. The material of this size also ensures a sufficient permeability of the gases that form during the dissolution of the lost molded parts, i.e., the polymer parts. In particular, this size brings about a high surface quality of the camshafts manufactured according to the invention.

Before the casting arrangement is filled with liquid casting material, a mold box 7 is filled up with sand in such a way as to completely envelop all meltable mold parts with sand. With respect to the camshaft models, completely enveloped denotes that the latter are completely encased by sand, even in their internal, profiled hollow cavity. The sand enveloping the mold parts is filled into the mold box 7 only as loose sand, and not compacted there in any special way. As the mold sand is filled in, the mold box 7 vibrates to achieve a good mold sand distribution.

In the mold box as prepared for filling in the casting material with casting arrangement inside, only the ceramic stoppers 6 sealing the casting channels 3 and a fill funnel of the central fill channel 1 project out of the filled-in sand.

If not manufactured as single pieces, the individual parts of the casting arrangement are simply fitted into each other in a non-positive manner. In particular, the fill channel 1 is fitted into a composite part comprised of the connecting channels 2, and the casting channels 3 are fitted into the connecting channels 2. The camshaft models 4 are also only pinned onto the respective casting channel 3, namely via the notched connections 5. Even the camshaft models 4 themselves can be built up out of individual parts in an axial direction and plugged together.

A casting arrangement molded into sand inside a mold box 7 is filled as follows.

Liquid casting material is introduced into the fill channel 1, and enters the casting channels 3 from below via the connecting channels 2. From there, the casting material penetrates through the notched connections 5 into the individual camshaft models 4, wherein the casting material rises uniformly in each respective casting channel 3 and the camshaft models 4 linked thereto. As the casting material penetrates into the casting channels 3, a casting pressure slightly exceeding atmospheric pressure is created therein by the ceramic stoppers 6. Exposed to the heat of the casting material, the individual mold parts of the casting arrangement dissolve in a manner commonly encountered in the known lost-foam casting procedure. The coating on the individual mold parts is of particular importance in achieving a good casting quality and ensuring a sufficient dimensional stability of the casting arrangement during the casting process.

After the casing process is over and the casting material has hardened, the casting material in the mold of the casting arrangement can simply be pulled out of the sand bed of the mold box 7, and the casting sand can be removed completely by shaking.

This provides an extremely rational manufacturing procedure. For example, more than 50 camshafts can be fabricated in a single system arrangement in a single casting operation. After manufactured in the described casting procedure, the individual camshafts must of course be machined to remove the respective sprues or runners. However, this can be easily accomplished using a conventional technical procedure.

A particularly favorable material for a camshaft manufacturable according to the invention has the following composition in % w/w:

| | |
|---|---|
| Carbon | 0.5 to 2.5% |
| Chromium | 1 to 18% |
| Silicon | 0.1 to 1% |
| Manganese | 0.1 to 1% |
| Molybdenum | 0.1 to 2% |
| Vanadium | 0.1 to 2% |
| Tungsten | 0.1 to 2% |
| other elements | up to 4% |
| remainder iron | |

After the casting procedure has concluded, the camshafts are preliminarily machined at the bearing and cam surfaces, reinforced at the boundary layers via inductive hardening, case hardening, carbonitriding or other comparable procedures and then finished. Finishing is best accomplished through grinding.

As a typical feature, camshafts according to the invention have a typical surface relief known from expanded polystyrene parts in areas that are not machined. The hollow cavity of the camshaft is not machined. Areas of the camshaft that are not specially reinforced at the boundary layers have a surface hardness of 150 to 400 HB. The procedure according to the invention limits the size of casting defects in an area of 1 mm below the cam surfaces to 0.1 mm. The cam surface there has a hardness of between 35 and 70 HRC, depending on the required surface pressure. The cam surface typically has internal stresses of between 50 and 600 MPa. The structure of the camshaft according to the invention is ferritic-pearlitic or iedeburitic. Martensitic or bainitic structures are typically present in the area of the boundary layer reinforcement.

In special embodiments of the boundary layer reinforcement according to the invention, the C, N or B contents can be elevated by 0.1 to 3% in this area.

What is claimed is:

1. A procedure for manufacturing a cast steel camshaft with an interior cavity in a "lost-foam" casting procedure with a meltable model (4), in which the camshaft is cast out of a material that is cast in a casting mold in a single casting process, and said model (4) is filled in and enveloped by mold sand, wherein the camshaft is poured by filling and melting out said model (4) with steel melt and wherein a length of the model (4) exhibits notches (5) to a casting channel (3) that runs axially parallel to a longitudinal axis of the model (4) along said length of the model (4) and is used exclusively for an ascending casting of the steel melt, wherein the casting channel (3) is filled with said steel melt from below and wherein a top end of the casting channel (3) is provided with a throttle valve for generating a pressure exceeding atmospheric pressure inside this channel (3) during the casting process.

2. The procedure according to claim 1, in which the camshaft has a profiled, cylindrical inner shape.

3. The procedure according to claim 1, characterized by the fact that the throttle valve is a ceramic stopper (6).

4. The procedure according to claim 1, characterized by the fact that several camshaft casting models (4) are connected, distributed along the periphery of a casting channel (3).

5. The procedure according to claim 1, characterized by the fact that several casting channels (3) are supplied by a shared fill channel (1) running roughly axially parallel to the casting channels (3).

6. The procedure according to claim 1, characterized by the fact that the camshaft models (4) and casting channels (1, 2, 3, 5) are at least partially interconnected by only plug connections.

7. The procedure according to claim 1, characterized by the fact that the camshaft models (4) consist of separate, individual parts that are only fitted into each other.

8. The procedure according to claim 6, characterized by the fact that all camshaft models (4) and casting channels (1, 2, 3, 5) are filled and enveloped by loosely poured casting sand only in a mold box.

* * * * *